United States Patent [19]

Goloff et al.

[11] 3,999,905

[45] Dec. 28, 1976

[54] ROTARY MECHANISM

[75] Inventors: Alexander Goloff, East Peoria; Thomas M. Albright, Chillicothe, both of Ill.

[73] Assignee: Caterpillar Tractor Co., Peoria, Ill.

[22] Filed: Nov. 17, 1975

[21] Appl. No.: 632,601

[52] U.S. Cl. ..... 418/94; 418/123; 418/124

[51] Int. Cl.[2] ..... F01C 19/04; F04C 27/00

[58] Field of Search ..... 418/93, 94, 113, 122–124, 418/267, 268

[56] References Cited

UNITED STATES PATENTS

| | | | |
|---|---|---|---|
| 677,531 | 7/1901 | Albert | 418/122 |
| 2,027,594 | 1/1936 | Huff | 418/94 |
| 3,261,334 | 7/1966 | Paschke | 418/123 |
| 3,343,526 | 9/1967 | Peras | 418/94 |
| 3,574,493 | 4/1971 | Hamilton | 418/268 |

FOREIGN PATENTS OR APPLICATIONS

| | | | |
|---|---|---|---|
| 449,832 | 7/1949 | Italy | 418/93 |
| 344,799 | 4/1960 | Switzerland | 418/124 |

*Primary Examiner*—John J. Vrablik
*Attorney, Agent, or Firm*—Wegner, Stellman, McCord, Wiles & Wood

[57] ABSTRACT

An improved rotary mechanism such as a rotary engine. The mechanism includes a main shaft with a rotor supporting portion thereon. A rotor is journalled on the supporting portion and has a plurality of apices. Each apex is provided with a seal retaining groove and a seal is disposed therein. A plurality of hydraulic passages are provided in the rotor, one for each apex seal, and open from the rotor to the rotor supporting portion of the main shaft. The rotor is provided with suitable devices for transmitting hydraulic pressure applied in each of the passages to the corresponding apex seal to bias the apex seal out of the groove into good sealing engagement with the operating chamber walls. A hydraulic fluid conduit is located in the main shaft and has a port terminating in the rotor supporting portion. The port is disposed to be periodically, serially aligned with the passages in the rotor for timed biasing of the apex seals as desired.

12 Claims, 3 Drawing Figures

Fig. 1
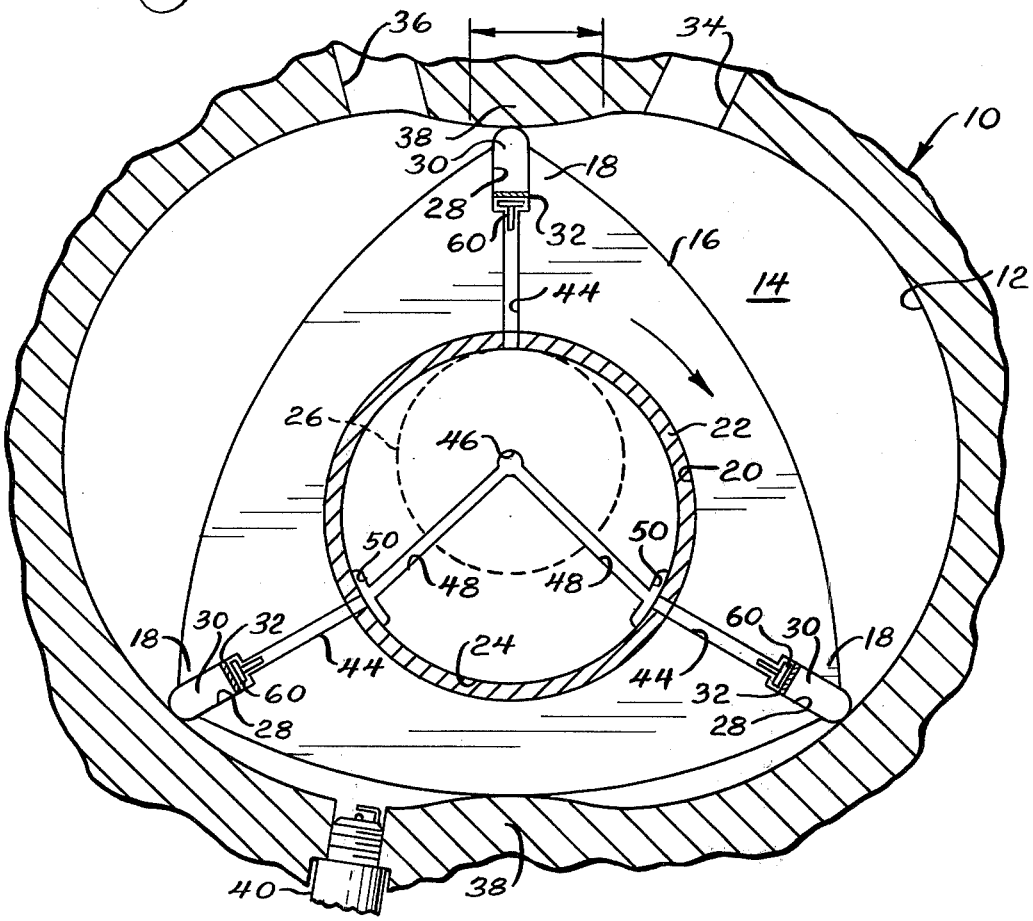
Fig. 2
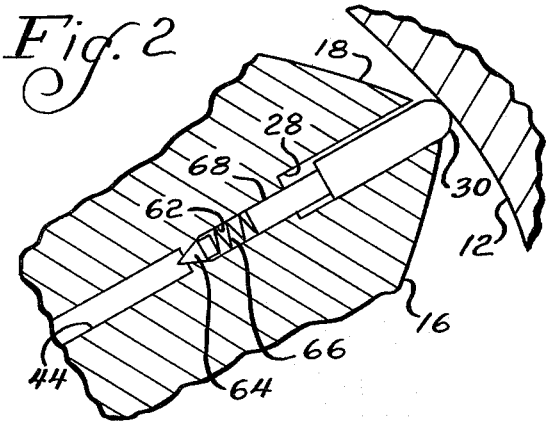
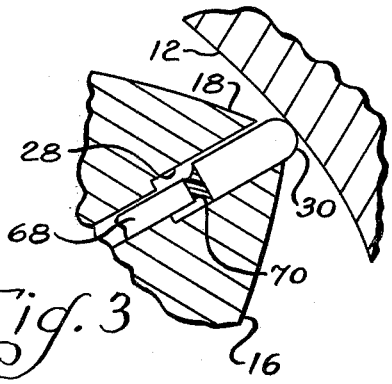
Fig. 3

ROTARY MECHANISM

BACKGROUND OF THE INVENTION

This invention relates to rotary mechanisms, and, more particularly, to improved means for biasing apex seals in such mechanisms into good sealing engagement with the chamber walls of the mechanism.

Prior art of possible relevance includes the following U.S. Pat. Nos. 3,456,625 to Jones et al, issued July 22, 1969; 3,482,551 to Jones, issued Dec. 9, 1969; and 3,496,916 to Jones, issued Feb. 24, 1970.

During high speed operation, the apex seals of rotary engines of the trochoidal type may become overloaded by centrifugal force. Since such seals normally operate with very thin oil films, such excessive loads accelerate wear and thus engine failure.

As a consequence, there have been a number of proposals for cancelling out or reducing the effects of such centrifugal forces. The approaches taken heretofore required the use of numerous small counterweights, levers, or, in some cases, friction devices. The above identified patents are illustrative of such approaches.

While such proposals result in the unloading of the apex seals at high rotative speeds, because they require a number of parts, the service life and reliability is subject to some question. Moreover, because of the number of parts, such devices are expensive to manufacture and difficult to assemble.

Moreover, in other rotary mechanisms, not necessarily of the trochoidal type, there occasionally exists a need for means whereby the biasing pressure against apex seals may be simply varied at different points in a cycle of rotation.

SUMMARY OF THE INVENTION

It is a principal object of the invention to provide a new and improved rotary mechanism. More specifically, it is an object of the invention to provide a rotary mechanism wherein the biasing force applied against apex seals or the like carried by the rotor of the rotary mechanism may be simply, but dependably, varied at different points during the operational cycle of such a mechanism. It is also an object of the invention to provide a new and improved trochoidal type rotary mechanism wherein suitable seal biasing pressures may be exerted against the seals at critical points in the cycle of such a mechanism without the result of overloading of the seals during high speed rotation due to centrifugal force.

The exemplary embodiment of the invention achieves the foregoing object in a structure including a main shaft having a rotor supporting portion. A rotor is journalled on the rotor supporting portion and is provided with plural apices. At each apex, a seal retaining groove receiving a corresponding apex seal is provided. The rotor is further provided with a plurality of hydraulic passages, one for each apex seal, each of which opens to the rotor supporting portion of the main shaft. The rotor is provided with means whereby hydraulic pressure applied in each of the passages is exerted against the corresponding apex seal to bias the apex seal out of the groove in which they are disposed into good sealing engagement with the chamber walls of the rotary mechanism. A hydraulic fluid conduit is located in the main shaft and includes a port terminating in the rotor supporting portion thereof at the interface of the same with the rotor. The port is disposed to periodically serially align with the rotor passages such that when hydraulic fluid under pressure is directed to the conduit during operation of the mechanism, the apex seals will be periodically biased by hydraulic pressure as mentioned previously.

In a preferred embodiment, each passage in the rotor includes a check valve for allowing the flow of hydraulic fluid toward the seals and precluding backflow from the seals so that high operating pressures generated in the operational chamber cannot flow back through the passages. According to one embodiment, the rotary mechanism is a trochoidal type mechanism and the seal receiving grooves open radially outwardly from the rotor at each apex. Moreover, each groove is provided with a biasing spring. By reason of the hydraulic assist, the springs can be chosen to have a relatively low spring rate, which spring rate is sufficiently low as to preclude excessive loading of the seals during high speed operation due to the combined effects of the spring and centrifugal force.

Where the trochoidal type mechanism is a rotary engine and the operating chamber includes a conventional waist with an inlet and an outlet adjacent one side, the port on the rotor supporting portion of the main shaft is located to align with the passages in the rotor when adjacent apex seals are disposed on opposite sides of the other side of the waist to insure good sealing during the power portion of the operating cycle.

According to one embodiment, the passages are in fluid communication with corresponding ones of the grooves so that hydraulic fluid directly biases the seals. In this case, the hydraulic fluid preferably is a lubricant so that small amounts thereof emanating from the grooves also serve to lubricate the apex seals.

According to another embodiment, each of the passages is provided with at least one plunger which extends out of the passage into engagement with the corresponding apex seal.

According to still a further embodiment, plungers are similarly provided and the plungers are flexibly connected to the apex seals so as to allow lateral shifting of the apex seals relative to the plungers to provide for conventional gas loading of the seals.

Other objects and advantages will become apparent from the following specification taken in connection with the accompanying drawings.

DESCRIPTION OF THE DRAWINGS

FIG. 1 is a view of a rotary mechanism made according to the invention with parts broken away for clarity;

FIG. 2 is an enlarged, fragmentary view of a modified embodiment of the invention; and FIG. 3 is an enlarged, fragmentary view of still another embodiment of the invention.

DESCRIPTION OF THE PREFERRED EMBODIMENTS

An exemplary embodiment of a rotary mechanism made according to the invention is illustrated in FIG. 1 in the form of a trochoidal engine, more specifically, a so-called "Wankel" engine. The same includes a center housing, generally designated 10, having an interior, chamber defining wall 12. The center housing 10 is flanked by end housings 14 (only one of which is shown) and disposed within the resulting chamber is a rotor 16 having plural apices 18.

The rotor 16 includes a central bore 20 receiving a bearing 22 which, in turn, is journalled on the eccentric 24, or rotor mounting portion, of the main shaft 26. The rotor 16, at each apex 18, includes a radially outwardly opening groove 28 for receipt of a corresponding apex seal 30. Within each groove 28, an undulating spring 32 is disposed for the purpose of biasing the corresponding apex seal 30 in a direction extending out of the groove 28 into sealing engagement with the wall 12. According to the invention, the springs 32 have a relatively low spring rate, i.e., considerably lower than that of springs conventionally employed in such engines.

The center housing 10 includes an inlet port 34 and an outlet port 36 disposed on opposite sides of one side of the conventional waist area 38 of the mechanism. At the opposite side of the waist area 38, a spark plug 40 is suitably disposed to ignite the compressed air-gas mixture to drive the engine through its so-called power stroke. Alternately, a fuel injection device could be used if the engine is configured to operate in the diesel range.

The rotor 16 is provided with a plurality of hydraulic fluid passages 44, one for each of the apices 18. Each passage 44 opens first to the underside of the corresponding apex seal 30 and at its opposite end, through the bearing 22 to the interface of the rotor 16 and the eccentric 24 on the main shaft 26.

The main shaft is provided with a conduit 46 through which hydraulic fluid under pressure may be introduced. Typically, the hydraulic fluid employed will be lubricating oil.

At the eccentric 24, a pair of conduits 48 in fluid communication with the conduit 46 extend in a generally radial direction to terminate in ports 50 at the interface of the eccentric 24 and the rotor 16. The ports 50 are axially aligned with the openings of the passages 44 through the bearings so that as the main shaft 26 rotates, periodically, the ports 50 will be aligned with the passages 44. As a consequence of this construction, hydraulic fluid under pressure will be directed to the underside of the apex seals 30 through a corresponding one of the passages 44 at periodic intervals to cause the apex seals to be biased into good sealing engagement with the chamber wall 12.

Preferably, the geometry is that illustrated in FIG. 1 so that the appropriate biasing of the apex seals 30 will occur at about dead center so that the apex seals 30 will be in good sealing engagement with the chamber walls 12 at the time of initiation of the power stroke to minimize gas leakage and thereby increase engine efficiency.

In this connection, preferably the grooves 28 are formed to have a width slightly greater than the width of the apex seals 30 in the embodiment according to FIG. 1. Normally, a spacing on the order of 0.0010 to 0.0015 inches will be sufficient. When lubricating oil is employed as the hydraulic fluid, such spacing allows a certain amount of oil to flow through such clearance to provide lubrication at the point of contact between the apex seal 30 and the chamber wall 12.

Because of such a spacing, and the fact, that in a practical sense, some spacing can never be eliminated without causing the apex seals 30 to bind in their respective grooves, each of the passages 44 is provided with a check valve shown schematically at 60 and arranged to allow fluid flow radially outwardly and preclude fluid flow radially inwardly. Thus, high pressures during operation cannot blow back through the passages 44.

A modified embodiment of the invention is illustrated in FIG. 2. According to this embodiment, the radially outer end of each passage 44 is slightly enlarged as at 62. A check valve 64 is disposed at approximately the interface between the major portion of the passage 44 and the enlargement 62 and the same, in turn, bears against a spring 66 which, in turn, bears against a plunger 68 operating as a piston in the enlargement 62. The plunger 68 extends out of the enlargement 62 of the passage 44 into the groove 28 of the corresponding apex 18 to engage the underside of the corresponding apex seal 30. According to this embodiment, there is very little flow of hydraulic fluid or lubricating oil from the passage 44 to the apex seal 30 by reason of the use of the plunger 68. Nonetheless, hydraulic forces are transmitted to the apex seals 30 to achieve the same effect.

Moreover, this embodiment of the invention permits the use of a somewhat wider groove 28 in each apex 18 so that gas energization of the apex seal 30 may be employed without excessive oil leakage.

Still a further modification of the invention is illustrated in FIG. 3. According to the embodiment illustrated in FIG. 3, the plungers 68 are flexibly connected to their corresponding apex seals 30. Preferably, a body 70 of an elastomer bonded to both the plunger 68 and the underside of the apex seal 30 is employed. In this embodiment, the flexible connection provided by the elastomer 70 allows the apex seal 30 to shift sidewardly within its associated groove 28 to achieve desirable side gas energization for good sealing.

It is to be noted that while only a single plunger has been shown in connection with the apex seals 30 in the embodiments of FIGS. 2 and 3, it is anticipated that several such plungers will be employed for each apex seal, such plungers being spaced axially along the width of the rotor.

From the foregoing, it will be appreciated that in trochoidal type engines, use of the invention enables the provision of low spring rate biasing springs for the apex seals 30 such that total biasing forces due to the springs in combination with centrifugal force do not become excessive. Nonetheless, adequate biasing of the apex seals 30, in critical areas, can be obtained through the hydraulic biasing provided according to the invention.

It is also to be understood that while the invention has been described in connection with a trochoidal engine, it is applicable to other rotary mechanisms such as compressors or pumps and which need not be trochoidal in nature. For example, the invention is applicable to apex seals and side seals in slant axis rotary mechanisms.

It will also be recognized that the location of the ports 50 may be varied as appropriate dependent upon the desired time in a given rotary cycle at which the seals are to be hydraulically assisted. As illustrated in FIG. 1, as the shaft 26 will rotate three times for each full rotation of the rotor 16, the seals 30 will always be given a hydraulic boost at about dead center. While the boost may occur at other points in the cycle as well, such boost are not harmful and therefore may be tolerated.

What is claimed is:

1. A rotary mechanism comprising: a rotating main shaft; a rotor supporting portion on said main shaft; a rotor journalled on said rotor supporting portion; a plurality of seal retaining grooves in said rotor, each open generally outwardly therefrom; a plurality of seals, one in each of said grooves; a plurality of hydraulic passages in said rotor, one for each seal, each opening to said rotor supporting portion; means for transmitting hydraulic pressure applied in each of said passages to the corresponding seal to bias the seal in a direction out of the corresponding groove; means defining an operating chamber encompassing said rotor and said seals such that said seals sealingly engage the walls of said chamber; and a hydraulic fluid conduit in said main shaft having a port terminating in said rotor supporting portion at the interface of the same and said rotor, said port being disposed to periodically, serially align with said passages whereby when hydraulic fluid under pressure is directed to said conduit during operation of said mechanism, said seals will be periodically biased by hydraulic pressure in a direction out of their respective grooves into good sealing engagement with said chamber wall.

2. A rotary mechanism comprising:

a rotating main shaft;

a rotor supporting portion on said main shaft;

a rotor journalled on said rotor supporting portion, said rotor having plural apices;

a seal retaining groove in said rotor at each of said apices;

a plurality of apex seals, one in each of said grooves;

a plurality of hydraulic passages in said rotor, one for each apex seal, each opening to said rotor supporting portion;

means for transmitting hydraulic pressure applied in each of said passages to the corresponding apex seal, to bias the apex seals in a direction out of the grooves in which they are disposed;

means defining an operating chamber encompassing said rotor and said seals such that said seals sealingly engage the walls of said chamber; and a hydraulic fluid conduit in said main shaft having a port terminating in said rotor supporting portion at the interface of the same and said rotor, said port being disposed to periodically, serially align with said passages, whereby when hydraulic fluid under pressure is directed to said conduit during operation of said mechanism, said apex seals will periodically be biased by hydraulic pressure in a direction out of their respective grooves into good sealing engagement with said chamber wall.

3. A rotary mechanism according to claim 2 further including check valve means in each of said passages for allowing the flow of fluid toward said seals and precluding fluid flow toward said rotor supporting portion.

4. A rotary mechanism according to claim 3 wherein said passages are in fluid communication with corresponding ones of said grooves.

5. A rotary mechanism according to claim 2 wherein said rotary mechanism is a trochoidal type mechanism and said grooves open radially outwardly from said rotor, and further including a plurality of springs, one in each groove, biasing the corresponding seal out of the groove, said springs having a relatively low spring rate.

6. A rotary mechanism according to claim 5 wherein said trochoidal type mechanism is an engine, said chamber defining means including a waist area; an inlet and an outlet in said chamber defining means in one side of said waist; said port being located on said rotor supporting portion to align with said passages to bias the corresponding apex seals near the opposite side of said waist area.

7. A rotary mechanism according to claim 2 further including a plurality of plungers, one for each passage, each said plunger being partially disposed on its corresponding passage and partially disposed in a corresponding groove and in engagement with the corresponding apex seal.

8. A rotary mechanism according to claim 7 wherein each said groove is wider than the seal received therein to permit gas energization of said seals.

9. A rotary mechanism according to claim 7 further including check valve means in each of said passages for allowing the flow of fluid toward said seals and precluding fluid flow toward said rotor supporting portion.

10. A rotary mechanism according to claim 9 wherein said check valve means comprise check valves in said passages and springs interposed between and engaging the check valves and the corresponding plungers.

11. A rotary mechanism according to claim 7 further including means flexibly connecting each of said apex seals to its associated plunger.

12. A rotary mechanism according to claim 11 wherein said flexible connecting means comprises an elastomer bonded to corresponding plungers and seals.

* * * * *